US006001793A

United States Patent [19]

Figdore et al.

[11] Patent Number: 6,001,793

[45] Date of Patent: Dec. 14, 1999

[54] CLEANING COMPOSITIONS

[75] Inventors: Phillip E. Figdore, York, Pa.; Charles J. Good, Ramsey, N.J.

[73] Assignee: Penetone Corporation, Tenafly, N.J.

[21] Appl. No.: 08/737,867

[22] PCT Filed: May 19, 1995

[86] PCT No.: PCT/US95/06807

§ 371 Date: Jun. 6, 1997

§ 102(e) Date: Jun. 6, 1997

[87] PCT Pub. No.: WO95/32275

PCT Pub. Date: Nov. 30, 1995

Related U.S. Application Data

[63] Continuation of application No. 08/246,040, May 19, 1994, abandoned.

[51] Int. Cl.[6] ..... C11D 7/00; C11D 3/18; C11D 3/44; C11D 14/02

[52] U.S. Cl. ..... 510/243; 510/245; 510/255; 510/365; 510/401; 510/417; 510/463

[58] Field of Search ..... 510/243, 245, 510/255, 365, 401, 417, 463

[56] References Cited

U.S. PATENT DOCUMENTS

| | | | |
|---|---|---|---|
| 1,723,923 | 8/1929 | Davidson | 252/148 |
| 3,634,338 | 1/1972 | Laugle et al. | 252/525 |
| 4,026,720 | 5/1977 | Ikeda | 106/287 SB |
| 4,066,398 | 1/1978 | Hwa | 21/2.7 A |
| 4,481,331 | 11/1984 | Liu | 525/92 |
| 4,511,488 | 4/1985 | Matta | 252/162 |
| 4,713,439 | 12/1987 | St. Clair et al. | 528/353 |
| 4,835,197 | 5/1989 | Mercer | 524/538 |
| 4,960,837 | 10/1990 | Alesbury | 525/420 |
| 5,025,069 | 6/1991 | Deguchi et al. | 252/174.17 |
| 5,124,062 | 6/1992 | Stevens | 252/162 |
| 5,156,760 | 10/1992 | Marchese et al. | 252/171 |
| 5,171,475 | 12/1992 | Freiesleben | 252/312 |
| 5,179,188 | 1/1993 | Mercer et al. | 528/219 |
| 5,213,624 | 5/1993 | Williams | 134/40 |
| 5,346,640 | 9/1994 | Leys | 252/162 |
| 5,696,072 | 12/1997 | Nercissiantz | 510/206 |

*Primary Examiner*—Yogendra N. Gupta
*Assistant Examiner*—John M Petruncio
*Attorney, Agent, or Firm*—Darby & Darby

[57] ABSTRACT

There are provided cleaning compositions for removing soils from a substrate. These compositions comprise (a) at least one $C_{10}$ or higher terpene hydrocarbon solvent, (b) at least one surfactant, (c) at least one metal corrosion inhibiting agent, (d) at least one hard surface stress crazing inhibiting agent, and (e) water, wherein, if the soil comprises oil, the composition forms an oil-removing oil and water emulsion with said oil for a time sufficient to remove the oil from the substrate, the oil removing emulsion releasing free water within twenty-four hours after formation, the composition having a pH of less than about 10.

27 Claims, 1 Drawing Sheet

CLEANING COMPOSITIONS

This application is a 371 of PCT/US95/06807 filed May 19, 1995, published on Nov. 30, 1995 as WO 95/32275, which is a continuation of U.S. Pat. application Ser. No. 08/246,040 filed on May 19, 1994, now abandoned.

FIELD OF THE INVENTION

This invention relates to cleaning compositions of optimized cleaning power which have anti-corrosion, anti-hard surface stress crazing, and anti-polyimide coated wire stress crazing properties. Additionally, a method for cleaning substrates with these compositions is provided.

BACKGROUND OF THE INVENTION

Cleaning of industrial machinery often presents unusual cleaning problems. Any given piece of machinery may include components made of many types of materials. Because of the complexity or the individual inaccessibility of the multiple components of such machines, a variety of components can be in contact with the cleaning composition during the cleaning process. Therefore, it is not only necessary for a cleaning composition clean properly, but the composition also must avoid causing damage to the various components and to the various materials in the components of the equipment.

A problem of this type was recognized by the United States Government when it published Military Specification No. MIL-C-87937B on Jan. 27, 1994, which discloses the requirements for cleaning compositions for aerospace equipment. These cleaning compositions must meet particular cleaning effectiveness standards and must not have specific detrimental effects on machinery components. For example, the composition cannot adversely affect painted and unpainted metal surfaces, cannot cause corrosion, and cannot cause stress crazing on acrylic or polycarbonate plastic. Additionally, it must not affect polysulfide sealants, and it must be compatible with rubber.

It has now been discovered that terpene-based cleaning compositions can be prepared which have properties appropriate for the industrial cleaning of multi-component machinery. These compositions are effective cleaners that avoid detrimental effects to the components of machinery, such as, for example, aircraft, aerospace ground equipment, and aerospace ground equipment engines. The presently disclosed combination of certain solvents, surfactants, and inhibiting agents yields a wide range of properties that are not typically attributed to these components. Furthermore, the combination of components yields an environmentally acceptable oil removing composition that cleans soiling, such as for example, oils, greases, particulates, carbon tracks, and the like, from a substrate. These compositions can form a water and oil emulsion with any oil in the soiling for a time sufficient to remove the oil and other soiling from the substrate, but then release free water from the emulsion. This is known as oil splitting.

SUMMARY OF THE INVENTION

Figure 1:
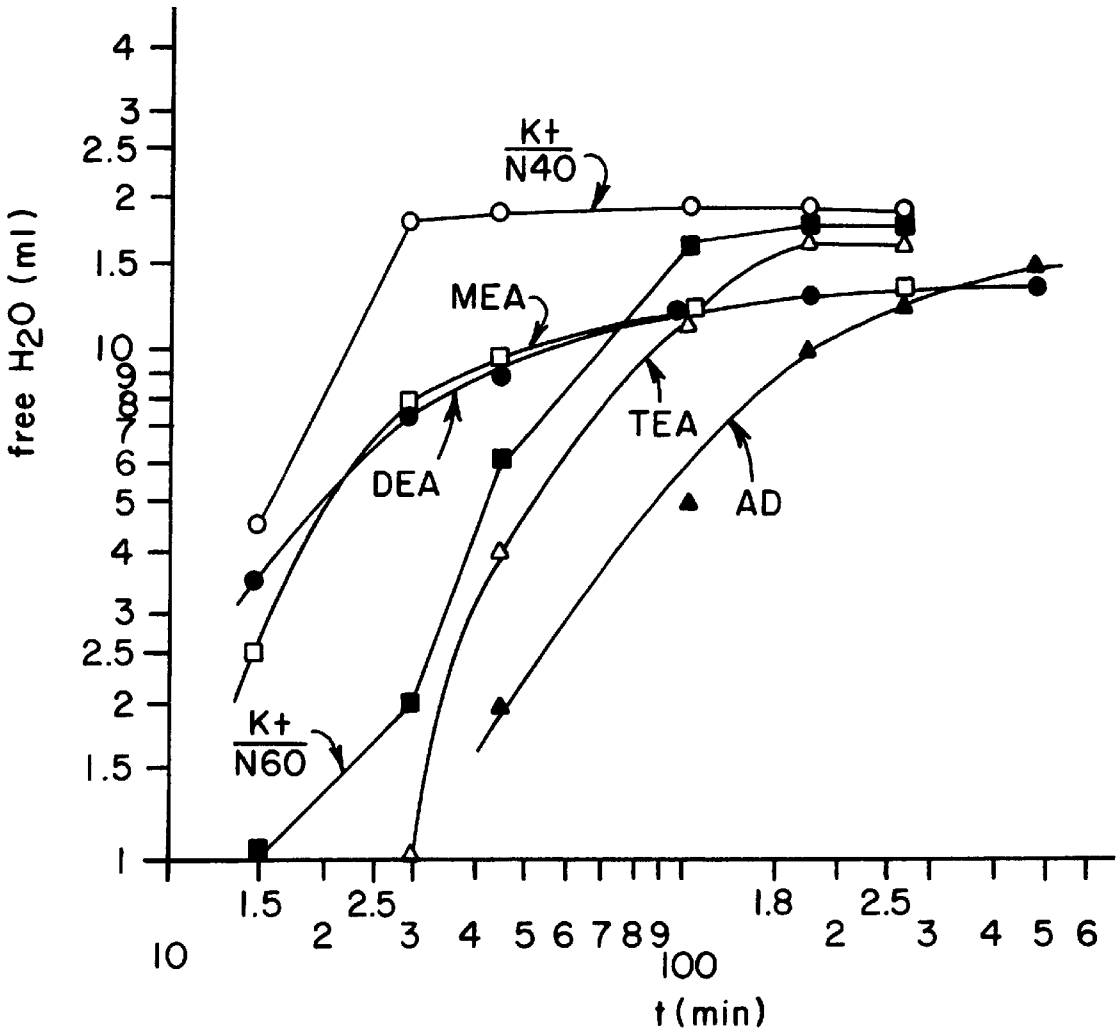
FIG. 1 is a graphic illustration of emulsion stability.

According to the present invention, there are provided cleaning compositions for removing soils from a substrate. These compositions comprise:

(a) at least one $C_{10}$ or higher terpene hydrocarbon solvent;

(b) at least one surfactant;

(c) at least one metal corrosion inhibiting agent;

(d) at least one hard surface stress crazing inhibiting agent; and (e) water;

wherein, if the soil comprises oil, the composition forms an oil removing oil and water emulsion with the oil for a time sufficient to remove the oil from the substrate, the oil removing emulsion releasing free water within twenty-four hours after formation; the composition having a pH of less than about 10.

Also contemplated by the present invention is a method for cleaning a substrate with these cleaning compositions.

DETAILED DESCRIPTION OF THE INVENTION

The cleaning compositions of the present invention are suitable for use in a variety of environments.

The solvents suitable for use in the present invention are $C_{10}$ or higher terpene hydrocarbons and poly($C_{10}$ or higher terpene hydrocarbons). Such terpenes include, but are not limited to, limonene, α-pinene, β-pinene, cis-pinene, camphene, δ-3-carene, terinolene, α-terpene, γ-terpinene, isoterpinoline, β-phellandrene, myrcene, ocimene, alloocimene, citronellene. Also included are all optical isomers of such terpenes and mixtures of one or more of such terpenes.

Particularly preferred is d-limonene. D-limonene is a by-product of the citrus industry, typically derived from the rinds or peels of citrus fruits.

Compatible co-solvents such as for example, glycolethers, can be added. The amount of co-solvent utilized ranges from about 1 to about 25 weight percent of the composition.

The compositions can either be homogeneous solutions or emulsions. Preferred emulsions can be either water-in-oil emulsions or oil-in-water emulsions, with oil-in-water emulsions being preferred.

Surfactants useful in the present invention include anionic, cationic, non-ionic, and amphoteric surfactants. Anionic surfactants include, but are not limited to, sulfates; sulfonates; phosphates; phosphonates; carboxylate soaps, including, but not limited to, $C_6$–$C_{24}$ fatty acid soaps such as, for example, potassium and triethanolamine neutralized fatty acids; and carboxylates. Suitable anionic surfactants also include, without limitation, water-soluble salts of alkyl benzene sulfonates; alkyl sulfates; alkcohol sulfates; alkyl sulfonates; alcohol sulfonates; alkylaryl sulfonates; alkyl polyethoxy ether sulfates; paraffin sulfonates; α-olefin sulfonates; α-sulfocarboxylates and their esters; alkyl glyceryl ether sulfonates; fatty acid monoglyceride sulfates and sulfonates; alkyl phenyl phenoxy ether sulfates; 2-acryloxyalkane-1-sulfonates; and β-alkyloxyalkane sulfonates.

Additionally included anionic surfactants are water-soluble salts, particularly the alkaline metal, ammonium, and alkanolammonium salts of organic sulfuric reaction products having their molecular structure and alkyl or alkaryl group containing from about 8 to about 22, especially from about 10 to about 20 carbon atoms and a sulfonic acid or sulfuric acid ester group (included in the term "alkyl" is the alkyl portion of acyl groups). Examples of this group of surfactants are the sodium potassium alkyl sulfates, especially those obtained by sulfating the higher alcohols ($C_8$–$C_{18}$) produced by reducing the glycerides of tallow or coconut oil and sodium or potassium alkylbenzene sulfonates, in which the alkyl group contains about 9 to about 15, especially about 1 1 to about 13 carbon atoms, in straight chain or branch chain configuration and those prepared from alkyl benzenes obtained by alkylation with straight chain chloroparaffins (using aluminum trichloride catalysts) or straight chain olefins (using hydrogen fluoride catalysts). Special mention is made of linear straight chain alkyl benzene sulfonates in which the average of the alkyl group is about 11.8 carbons ($C_{11.8}$LAS).

Special mention is also made of anionic detergent compounds including the sodium $C_{10}$–$C_{18}$ alkyl glyceryl ether sulfonates, especially those ethers of higher alcohols derived from tallow and coconut oil, sodium coconut oil fatty acid monoglyceride sulfonates and sulfates; and sodium or potassium salts of alkyl phenyl ethylene oxide ether sulfate containing about 1 to about 10 units of ethylene oxide per molecule and wherein the alkyl groups contain about 8 to about 12 carbon atoms.

Also included are the water soluble salts or esters of α-sulfonated fatty acids containing from about 6 to about 24 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 atoms in the alkane moiety; alkyl ether sulfates containing from about 10 to about 18, especially about 12 to 16 carbon atoms in the alkyl group and from about 1 to 12, especially 1 to 6, more especially 1 to 4 moles of ethylene oxide; water soluble salts of olefin sulfonates containing from about 12 to 24, preferably 14 to 16 carbon atoms especially those made by reaction with sulfur trioxide followed by neutralization under conditions such that any sulfones present are hydrolyzed to the corresponding hydroxy alkane sulfonate; water soluble salts of paraffin sulfonates containing from about 8 to 24, especially 14 to 18 carbon atoms and β-alkyloxy alkane sulfonates containing from about 1 to about 3 carbon atoms in the alkyl group and from about 8 to 20 carbon atoms in the alkane moiety. Salts of alkaryl polyether sulfonates can also be utilized.

Suitable non-ionic surfactants include, but are not limited to, alkoxylated compounds produced by the condensation of alkylene oxide groups (hydrophilic in nature) with an organic hydrophobic compound (aliphatic, aromatic, or aryl aromatic). Non-limiting examples of suitable non-ionic surfactants also include the polyethylene oxide condensates of alkyl phenols, i.e., condensation products of alkyl phenols having an alkyl group containing from 6 to 12 carbon atoms in either a straight chain or branched chain configuration, with ethylene oxide, being present in amounts equal to 5 to 25 moles of ethylene oxide per mole of alkyl phenol. The alkyl substituent in such compounds may be derived, for example, from polymerized propylene, diisobutylene, octene, and nonene. Other examples include dodecylphenol condensed with 12 moles of ethylene oxide per mole of phenol; dinonylphenol condensed with 15 moles of ethylene oxide per mole of phenol; nonylphenyl and di-iso-isooctylphenol condensed with 15 moles of ethylene oxide.

Further examples of suitable non-ionic surfactants are the condensation products of primary or secondary aliphatic alcohols having from 8 to 24 carbon atoms, in the either straight chain or branched chain configuration, with 1 to about 30 moles of alkylene oxide per mol of alcohol. Preferably, the aliphatic alcohol comprises between 9 and 15 carbon atoms and is ethoxylated with between 2 and 12, preferably between 3 and 9 moles of ethylene oxide per mole of aliphatic alcohol.

Other non-ionic compounds useful in the present invention can be prepared by condensing ethylene oxide with a hydrophobic base formed by the condensation of propylene oxide with either propylene glycol or ethylene diamine.

Typically, the hydrophilic-lipophilic balance (HLB) of the non-ionic surfactant should be less than about 12. Preferably, the HLB should be less than about 11, and most preferably, the HLB should be less than about 10.

Suitable amphoteric surfactants include, but are not limited to, water soluble derivatives of aliphatic secondary and tertiary amines in which the aliphatic moiety can be straight chain or branched and wherein one of the aliphatic substituents contains from about 8 to 18 carbon atoms and one of the aliphatic substituents contains an anionic water-soluble group, e.g. carboxy, sulfonate, sulfate, phosphate, or phosphonate.

Suitable cationic surfactants include, but are not limited to, tertiary and quaternary water-soluble amine, stearyl dimethyl benzyl ammonium chloride, benzalkonium chloride, amido alkyl amine oxides, alkyl dimethylamine oxides, and a hydrogenated tallow amino-steryl amine plus a vegetable amine.

Mixtures of any of the surfactants above are useful as well, with the exception of mixtures of anionic and cationic surfactants. If a combination of anionic and non-ionic surfactants is used, preferably the weight ratio of anionic surfactant to non-ionic surfactant will range from about 1:1 to about 3:1. Most preferably, the ratio will be about 2:1.

Preferred surfactants are the potassium or triethanolamine fatty acid salts, and most preferably $C^6$–$C_{24}$ fatty acid salts, or alcohol sulfates/non-ionic surfactant mixtures. Special mention is also made of potassium or triethanolamine soaps mixed with nonyl phenyl ethoxylate wherein the ethoxylate contains less than about 10 moles and preferably less than about 7 moles of ethylene oxide.

Suitable anti-corrosion agents are those agents that inhibit the corrosion of metal. These agents include, but are not limited to, amines, including amine soaps, glycol amines, and alkanol amines, and particularly low molecular weight alkanol amines such as, for example, mono-, di-, and triethanolamine. Also suitable are barium sulfonate oils, sodium 2-mercapto-benzothiazole, tolyltrizole, and disodium 2,5-dimercapto-1,3,4-diazole. When an amine is used, the pKa of the amine should be about 9 or less, preferably about 8.5 or less, and most preferably about 8 or less.

The corrosion inhibiting agent can be selected according to the metal that will contact the cleaning composition. For example, tolyltriazole gives good corrosion protection for magnesium and cadmium, while triethanolamine is preferred for protecting steel and aluminum.

Preferred compositions include amines such as mono-, di-, or tri-ethanolamine or glycolamine with a pKa of less than about 9, preferably less than about 8.5, and most preferably less than 8; and potassium and triethanolamine neutralized $C_6$–$C_{24}$ fatty acids, the potassium or triethanolamine salts of anionic surfactants, or combinations thereof in the ratios described above.

Stress crazing inhibiting agents useful in the present invention are particularly directed to the stress crazing of hard surfaces such as polycarbonates and acrylics. Suitable hard surface stress crazing inhibiting agents include, but are not limited to, $C_{10}$ or higher saturated or mono-unsaturated hydrocarbons. These include α-olefins, paraffinic compounds, cycloparaffinic compounds, naphthenic compounds, naphthenic oils, and mineral oils. A preferred α-olefin is 1-decene. A preferred naphthenic oil is sold under the trade name Shell MVI-200 by Shell Oil Company.

The pH of the cleaning composition should be less than about 10, preferably less than about 9.8, and most preferably less than about 9.5 in order to maintain anti-polyimide coated wire stress crazing properties.

The amount of terpene solvent is generally a cleaning effective amount. Typically, the amount of terpene solvent ranges from about 1 to about 60 weight percent of the composition. Preferably, the amount of terpene solvent ranges from about 25 to about 40 weight percent of total composition.

The amount of surfactant is generally that amount effective to prepare an emulsion or a stable solution, i.e., a solution that does not separate into its individual components for at least one month, and typically ranges from about 1 to about 40 weight percent of the composition.

The amount of corrosion inhibiting agent is generally a corrosion inhibiting amount. Typically, this amount ranges from about 0.01 to about 10 parts by weight based upon 100 parts by weight of total composition.

The amount of hard surface stress crazing inhibiting agent is generally a hard surface stress crazing inhibiting amount. Typically, the amount of this agent ranges from about 0.05 to about 10 parts by weight based upon 100 parts by weight of total composition. Preferably, the amount of hard surface stress crazing inhibiting agent ranges from about 0.1 to about 5 parts by weight, and most preferably, the amount of this agent ranges from about 0.5 to about 5 parts by weight on the same basis.

Any additional components well known in the art to be included in the cleaning compositions are within the scope of the present claims. Among those contemplated are colorants, fragrances, preservers, antioxidants, biocides, thickeners, chelators, builders, or combinations thereof.

The cleaning compositions of the present invention are particularly suited for cleaning or removing oils from a substrate. When removing oils from a substrate with the present cleaning compositions, the composition forms a water and oil emulsion with the soiling oil, and this emulsified oil is removed from the substrate. This emulsion is maintained for a period of time sufficient to allow for the removal of the emulsion from the environment of the substrate, this amount of time being easily determined by those skilled in the art. Methods of removal of the emulsion are known to those skilled in the art, as well. The emulsion contains the soiling oil as well as water. However, because of environmental waste disposal concerns, it is desirable in many cleaning applications to remove oil and other soiling components of the emulsion from the water of the emulsion after the soiling oil is removed from the substrate. This is known as oil splitting. The compositions of the present invention form the oil removing emulsion, and within twenty-four hours after formation of the oil removing emulsion, the emulsion releases free water. Preferably, this occurs within less than eight hours of the formation of the oil removing emulsion.

The cleaning compositions of the present invention are prepared by methods known to those skilled in the art such as mixing and blending and are prepared with equipment conventional in the art.

The cleaning compositions of the present invention are useful to clean substrates such as aircraft, aerospace machinery, and aerospace engines and the like, and are applied by methods known to those skilled in the art such as wiping, spraying, padding, and the like.

DESCRIPTION OF THE PREFERRED EMBODIMENTS

The following examples illustrate the invention without limitation. All of the parts are given by weight percent based on total composition unless otherwise indicated. Test procedures are those noted in Military Specification MIL-C-87937B (Jan. 27, 1994) unless otherwise indicated.

EXAMPLE 1

The formulations of the cleaning composition as described in Table 1 below were prepared.

TABLE 1

| | Cleaning Compositions | | |
|---|---|---|---|
| | No. 1 | No. 2 | No. 3 |
| D-limonene | 31.0 | 27.0 | 27.0 |
| Tolyltriazole | 0.3 | 0.3 | 0.3 |
| BHT | 0.1 | 0.1 | 0.1 |
| Pine Oil | 1.3 | 1.3 | 1.3 |
| Dipropylene Glycol | 2.7 | 2.7 | 2.7 |
| Water | 21.0 | 25.0 | 29.0 |
| Butyl Carbitol | 9.0 | 9.0 | 9.0 |
| 25% Rosin Tall Oil | 10.0 | 10.0 | 10.0 |
| Triethanolamine | 13.6 | 10.0 | 5.1 |
| Potassium Hydroxide, 45% | — | — | 3.8 |
| Diethanolamine | — | 3.6 | — |
| Nonyl Phenol Ethoxylate (6 mole) | 10.0 | 10.0 | 10.0 |
| Naphthenic Oil Shell MVI 200 | 1.0 | 1.0 | 1.0 |
| pH | 8.55 | 9.14 | 9.40 |

EXAMPLE 2

Test Prcedure: The polyimide coated wire from two sources was added to 4 ounce jars with a 1.5 inch mouth filled with each cleaning solution. 6 inch wire lengths were stretched to form one coil (with a maximum diameter of 1.5 inches) and placed in a jar with the ends out of solution. Jars were capped and placed at 100° F. Jars were removed from the oven periodically and examined visually under 40 power magnification.

The following components were tested according to the procedure and produced passing results:

Pine Oil

D-limonene

Dipropylene glycol (neat)

Dipropylene glycol (20%

Diethylene glycol monobutyl ether (neat)

Diethylene glycol monobutyl ether (20% aqueous solution)

Terpene hydrocarbon emulsion with TEA alkalinity at pH 8.5

Results are further illustrated in Table 2 below.

COMPARATIVE EXAMPLE 2A

The following components were tested according to the procedure of Example 2 and produced failing results:

Terpene hydrocarbon emulsion, pH 9.9

Terpene hydrocarbon emulsion, pH 9.0

Terpene hydrocarbon emulsion, all DEA alkalinity to pH 9.0

Terpene hydrocarbon emulsion, DEA and TEA alkalinity to pH 9.0 (border line)

10% MEA Soap (cracks on reverse wrap only)

20% Nonylphenol ethoxylate (cracks on reverse wrap only)

20% DEA

Liquid alkaline cleaner pH 11.6 (non-amine formula)

The results are further illustrated in Table 2 below.

TABLE 2

Polyimide Coated Wire Stress Crazing

| Product/Component | Observation points (days) 1 | 5 | 6 | 9 | 12 | 25 |
|---|---|---|---|---|---|---|
| 20% MEA pH 12.5 | 5 | — | 6 | 6 | 6 | 6 |
| 20% DEA pH 11.5 | 0 | — | 4 | 4 | — | 5 |
| 10% MEA Soap pH 8.5 | 0 | — | 0 | — | 0 | 1 |
| Terpene emulsion, pH 9.9[A] | 0 | — | 5 | 5 | 5 | 6 |
| Terpene emulsion, pH 9.0[A] | 0 | — | 0 | 5 | 5 | |
| *Terpene emulsion, all DEA pH 9[A] | 0/0 | 0/0 | — | 4/1 | 414 | — |
| *Terpene emulsion, all TEA pH 8.5[A] | 0/0 | 0/0 | — | 4/0 | 4/0 | — |
| *Terpene emulsions, DEA/TEA pH 9.0 | 0/0 | 0/0 | 1/0 | 1/1 (on seam) | 2/2 | — |
| Liquid Alkaline Cleaner, pH 11.6 | 0 | — | 4 | — | — | 5 |

0 — No effect
1 — Cracks visible only on reverse wrap
2 — Cracks in insulation on seams
3 — Cracks no on seams visible under magnification
4 — Cracks on seams visible without magnification
5 — Insulation completely dissolved except for clear tight coating
6 — Insulation completely dissolved except for clear Ioose coating
* — Old wire/new wire
Note: New wire coating is less uniform than old wire coating
[A] — The compositions of these terpene emulsions are illustrated in Table 3 below

TABLE 3

Terpene Hydrocarbon Emulsions

| Product/Component Material | pH 9.9 % | pH 9.0 % | all DEA/pH 9.0 % | DEA/TEA % | TEA/pH 8.0 % |
|---|---|---|---|---|---|
| D-limonene | 27.0 | 23.9 | 27.0 | 27.0 | 27.0 |
| Tolyltriazole | 0.3 | 0.3 | 0.3 | 0.3 | 0.3 |
| BHT | 0.1 | 0.1 | 0.1 | 0.1 | 0.1 |
| Pine Oil | 1.3 | 1.2 | 1.3 | 1.3 | 1.3 |
| Dipropylene Glycol | 2.7 | 2.4 | 2.7 | 2.7 | 2.7 |
| Water | 31.1 | 29.3 | 32.8 | 25.0 | 25.0 |
| Diethylene Glycol Monobutyl Ether | 9.0 | 8.0 | 9.0 | 9.0 | 9.0 |
| Tall Oil, 25% Rosin | 10.0 | 18.4 | 10.0 | 10.0 | 10.0 |
| Nonyl Phenol Ethoxylate (6 mole) | 10.0 | 8.9 | 10.0 | 10.0 | 10.0 |
| Naphthenic Oil | 1.0 | 0.9 | 1.0 | 1.0 | 1.0 |
| Monoethanolamine | 2.5 | 2.2 | — | — | — |
| Diethanolamine | 5.0 | 4.4 | 5.8 | 3.6 | — |
| Triethanolamine | — | — | — | 10.0 | 13.6 |
| | 100.0 | 100.0 | 100.0 | 100.0 | 100.0 |

The results of the above tests showed that polyimide was sensitive not only to pH but to sources of alkalinity, particularly amines.

EXAMPLE 3

The compositions of Example 1 were tested according to the proceedure of Example 2 with passing results.

EXAMPLE 4

Five cleaning solutions were prepared according to the formulations of Table 4.

TABLE 4

Formulations Used for Oil Split-Out Tests (Stability)

| Product/Component | K +/ N40 | K +/ N60 | MEA/ N60 | DEA/ N60 | TEA/ N60 |
|---|---|---|---|---|---|
| D-limonene | 27.0 | 27.0 | 27.0 | 27.0 | 27.0 |
| 25% Rosin Tall Oil | 12.0 | 12.0 | 12.0 | 12.0 | 12.0 |
| Nonyl phenol ethoxylate (4 mole) | 4.0 | — | — | — | — |
| Nonyl phenol ethoxylate (6 mole) | — | 4.0 | 4.0 | 4.0 | 4.0 |
| Pine Oil | 5.0 | 5.0 | 5.0 | 5.0 | 5.0 |
| Dipropylene Glycol | 4.0 | 4.0 | 4.0 | 4.0 | 4.0 |
| Butyl Carbitol | 16.0 | 16.0 | 16.0 | 16.0 | 16.0 |
| Naphthenic oil Shell MVI-200 | 2.0 | 2.0 | 2.0 | 2.0 | 2.0 |
| Potassium Hydroxide, 45% | 4.92 | 4.92 | — | — | — |
| Monoethanolamine | — | — | 2.41 | — | — |
| Diethanolamine | — | — | — | 4.16 | — |
| Triethanolamine | 0.5 | 0.5 | 0.5 | 0.5 | 6.0 |
| Water | to 100 | to 100 | to 100 | to 100 | to 100 |

Stability of the emulsion was measured according to Mil-C-8793-B.

Results are illustrated in FIG. 1.

EXAMPLE 5

Five cleaning formulations were prepared according to Table 5.

TABLE 5

Plastic Anti-Crazing Formulations

| | A | B | C | D | E |
|---|---|---|---|---|---|
| D-limonene | 27.0 | 27.0 | 30.0 | 27.0 | 27.0 |
| Tolyltriazole | 0.3 | 0.3 | 0.3 | 0.3 | 0.3 |
| BHT | 0.1 | 0.1 | 0.1 | 0.1 | 0.1 |
| Pine Oil | 1.3 | 1.3 | 1.3 | 1.3 | 1.3 |
| Dipropylene Glycol | 2.7 | 2.7 | 2.7 | 2.7 | 2.7 |
| Water | 31.10 | 32.1 | 29.1 | 27.1 | 31.1 |
| Butyl Carbitol | 9.0 | 9.0 | 9.0 | 9.0 | 9.0 |
| 25% Rosin Tall Oil | 10.0 | 10.0 | 10.0 | 10.0 | 10.0 |
| Diethanolamine | 5.0 | 5.0 | 5.0 | 5.0 | 5.0 |
| Nonyl phenyl ethoxylate (6 moles) | 10.0 | 10.0 | 10.0 | 10.0 | 10.0 |
| Monoethanolamine | 2.5 | 2.5 | 2.5 | 2.5 | 2.5 |
| Wintergreen | 1.0 | — | — | — | — |
| 1-Dodecene | — | — | — | 5.0 | — |
| Naphthenic Oil Shell MVI 200 | — | — | — | — | 1.0 |

Stress crazing was tested on both polycarbonate plastic and acrylic plastic conforming with Mil-P-83310 according to the test methods of ASTM F484 and Mil-C-87937-B using the formulations described in Table 5. Results are illustrated in Tables 6 and 7 below.

TABLE 6

Stress Crazing Polycarbonate Plastic Mil-P-83310

| | Poly-carbonate Lexan 9600 | Source 1 Mil-P-83310 | Source 2 Mil-P-83310 |
|---|---|---|---|
| A | Fail | Fail | Fail, light craze |
| B | Fail | Fail | Fail |

TABLE 6-continued

| Stress Crazing Polycarbonate Plastic Mil-P-83310 | | | |
|---|---|---|---|
| | Poly-carbonate Lexan 9600 | Source 1 Mil-P-83310 | Source 2 Mil-P-83310 |
| C | Fail | Fail | Fail |
| D | Pass | — | Pass |
| F | Pass | — | Pass |

TABLE 7

| Stress Crazing Acrylic Plastic, ASTM F484 | | |
|---|---|---|
| | Type A | Type C |
| A | Pass | Pass |
| B | Pass | Pass |
| C | Pass | Pass |
| D | Pass | Pass |
| F | Pass | Pass |

EXAMPLES 6 AND 7 AND COMPARATIVE EXAMPLE 6A

The cleaning compositions of Table 8 were prepared and tested.

TABLE 8

| Cleaning Compositions | | | |
|---|---|---|---|
| Example | Example 6 | Example 6A | Example 7 |
| Composition | | | |
| Solvent (%) (D-limonene, Dipropylene Glycol, Pine Oil, Diethylene Glycol Monobutylether) | 40 | 40 | 40 |
| Surfactant (%) (Nonyl Phenol Ethoxylate (6 mole)), 25% Rosin Tall Oil Soap) | 20 | 20 | 20 |
| Hard Surface Stress Crazing Inhibiting Agent (%) (Naphthenic Oil) | 1 | 0 | 1 |
| Corrosion Inhibiting Agent (%) (Polytriazole) | 0.2–0.3 | 0.2–0.3 | 0.2–0.3 |
| Free Amine (%) (Mono-/di-/tri-ethanolamine) (%/%/%) | 0/0/2 | 8/2/0 | 0/0/0.5 |
| pH | 9.55 | 11.2 | 9.1 |
| Anionic Surfactant Counterion | Potassium | Monoethanol-amine | Potassium |
| Anionic/Nonionic Ratio | 3/1 | 1/1 | 2/1 |
| Properties | | | |
| 0:1 Split Test | Pass | Fail | Pass |
| Polyimide Wire Crazing | — | Fail | Pass |
| Polycarbonate Crazing | Pass | Fail | Pass |
| Acrylic Crazing | Pass | Pass | Pass |
| Mg Corrosion ($mg/cm^2$/24 hr.) | 0.73 | 0.14 | 0.17 |

All patents, publications, standards, military specifications, and test methods mentioned herein are hereby incorporated by reference. Many variations of the present invention would suggest themselves to those skilled in the art in light of the above-detailed description. All such obvious variations are within the scope of the appended claims.

We claim:

1. A cleaning composition non-corrosive to metal and non stress crazing to a plastic hard surface upon removal by said composition of soil from a substrate comprised of metal and/or plastic consisting essentially of (a) from about 25 to about 40 weight percent of at least one $C_{10}$ or higher terpene hydrocarbon solvent, (b) an emulsion or stable solution forming effective amount of at least one surfactant, (c) a corrosion inhibiting effective amount of at least one metal corrosion inhibiting agent;

(d) a hard surface stress crazing inhibiting amount of at least one hard surface stress crazing inhibiting agent selected from the group consisting of $C_{10}$ or greater saturated or mono-unsaturated hydrocarbons, and (e) water, wherein, if said soil comprises oil, said composition forms an oil-removing oil and water emulsion with said oil for a time sufficient to remove said oil from said substrate, said oil-removing emulsion releasing free water within twenty-four hours after formation; said composition having a pH of less than about 10.

2. A composition as defined in claim 1, wherein said oil removing emulsion releases free water within eight hours after formation.

3. A composition as defined in claim 1, wherein said solvent comprises a $C_{10}$ terpene hydrocarbon.

4. A composition as defined in claim 3, wherein said terpene is selected from the group consisting of limonene, alpha-pinene, beta-pinene, cis-pinene, camphene, delta-3-carene, terpinolene, alpha-terpinene, gamma-terpinene, isoterpinolene, beta-phellandrene, myrcene, ocinene, alloocinene, citronellene, and any optical isomers thereof.

5. A composition as defined in claim 3, wherein said terpene comprises d-limonene.

6. A composition as defined in claim 1, which includes at least one surfactant selected from the group consisting of anionic surfactants, cationic surfactants, non-ionic surfactants, and amphoteric surfactants.

7. A composition as defined in claim 6, wherein said surfactant comprises a non-ionic surfactant having an HLB of less than 12.

8. A composition as defined in claim 7, wherein said non-ionic surfactant is selected from the group consisting of octyl phenyl ethoxylate, nonyl phenyl ethoxlate, an alcohol ethoxylate, and any combination thereof.

9. A composition as defined in claim 6, wherein said anionic surfactant is selected from the group consisting of sulfates, sulfonates, phosphates, phosphonates, carboxylates, and any combination thereof.

10. A composition as defined in claim 9, wherein said sulfate is selected from the group consisting of alkyl sulfates and alcohol sulfates and said sulfonate is selected from the group consisting of alkyl sulfonates, alcohol sulfonates, and alkylaryl sulfonates.

11. A composition as defined in claim 9, wherein said anionic surfactant comprises a carboxylate.

12. A composition as defined in claim 11, wherein said carboxylate is selected from the group consisting of potassium $C_6$–$C_{24}$ fatty acid soaps and triethanolamine $C_6$–$C_{24}$ fatty acid soaps.

13. A composition as defined in claim 6, wherein said surfactant comprises a combination of an anionic surfactant and a non-ionic surfactant wherein the weight ratio of anionic surfactant to non-ionic surfactant ranges from about 1:1 to about 3:1.

14. A composition as defined in claim 13, wherein said anionic surfactant is selected from the group consisting of sulfates, sulfonates, phosphates, phosphonates, carboxylates, and any combination thereof.

15. A composition as defined in claim 14, wherein said surfactant comprises a combination of an anionic alcohol sulfate surfactant and a non-ionic surfactant.

16. A composition as defined in claim 14, wherein said carboxylate is selected from the group consisting of potassium $C_6$–$C_{24}$ fatty acid soaps and triethanolamine $C_6$–$C_{24}$ fatty acid soaps.

17. A composition as defined in claim 1, wherein said metal corrosion inhibiting agent comprises an amine soap.

18. A composition as defined in claim 1, wherein said metal corrosion inhibiting agent comprises tolyltriazole.

19. A composition as defined in claim 1, wherein said metal corrosion inhibiting agent is selected from the group consisting of an amine, an alkanolamine, and a glycolamine, wherein the pKa of said agent is less than about 9.

20. A composition as defined in claim 1, wherein said hard surface stress crazing inhibiting agent is selected from the group consisting of alpha-olefins, paraffins, cycloparaffins, naphthenes, naphthenic oils, mineral oils, and any combination thereof.

21. A composition as defined in claim 20, wherein said alpha-olefin is 1-decene.

22. A composition as defined in claim 1, comprising from about 25 to about 40 weight percent of component (A), from about 1 to about 40 weight percent of components (B), and from about 0.1 to about 10 weight percent of component (C).

23. A composition as defined in claim 1, which is an emulsion.

24. A composition as defined in claim 23, which is an oil-in-water emulsion.

25. A composition as defined in claim 1, further comprising:

(a) a colorant, (b) a fragrance, (c) a preservative, (d) an antioxidant, (e) a biocide, (f) a thickener, (g) a chelator, (h) a builder, or (i) any combination thereof.

26. A composition non-corrosive to metal and non stress crazing to a plastic hard surface upon removal by said composition of oil from a substrate comprised of metal and/or plastic consisting essentially of (a) from about 25 to about 40 weight percent of at least one $C_{10}$ or higher terpene hydrocarbon solvent;

(b) an emulsion or stable solution forming effective amount of at least one surfactant, c) a corrosion inhibiting effective amount of at least one metal corrosion inhibiting agent;

(d) a hard surface stress crazing inhibiting amount of at least one hard surface stress crazing inhibiting agent selected from the group consisting of $C_{10}$ or greater saturated or mono-unsaturated hydrocarbons, and (e) water, wherein said composition forms an oil removing oil and water emulsion with said oil for a time sufficient to remove said oil from said substrate, said oil removing emulsion releasing free water within twenty-four hours after formation, said composition having a pH of less than about 10.

27. A method for cleaning a substrate comprising a applying a composition as defined in claim 1 to said substrate.

* * * * *